US009412292B2

(12) United States Patent
Lee

(10) Patent No.: US 9,412,292 B2
(45) Date of Patent: Aug. 9, 2016

(54) DISPLAY DEVICE AND DRIVING METHOD THEREOF

(71) Applicant: SAMSUNG DISPLAY CO., LTD., Yongin, Gyeonggi-Do (KR)

(72) Inventor: Joo Hyung Lee, Bucheon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/203,516

(22) Filed: Mar. 10, 2014

(65) Prior Publication Data

US 2015/0097870 A1 Apr. 9, 2015

(30) Foreign Application Priority Data

Oct. 8, 2013 (KR) ..... 10-2013-0119973

(51) Int. Cl.

| | |
|---|---|
| ***G09G 5/10*** | (2006.01) |
| ***G09G 3/20*** | (2006.01) |
| ***G09G 3/32*** | (2016.01) |

(52) U.S. Cl.

CPC ..... *G09G 3/2096* (2013.01); *G09G 3/3233* (2013.01); *G09G 3/3275* (2013.01); *G09G 2320/0673* (2013.01); *G09G 2330/028* (2013.01)

(58) Field of Classification Search

USPC ..... 345/204, 211, 690, 691, 213, 69, 89

See application file for complete search history.

(56) References Cited

U.S. PATENT DOCUMENTS

| | | | | |
|---|---|---|---|---|
| 8,305,320 | B2 * | 11/2012 | Kim | H04N 19/184 345/690 |
| 2003/0142084 | A1 * | 7/2003 | Chang et al. | 345/204 |
| 2010/0141638 | A1 * | 6/2010 | Kim | H04N 19/184 345/213 |
| 2010/0309236 | A1 * | 12/2010 | Min et al. | 345/691 |
| 2013/0093742 | A1 * | 4/2013 | Lin et al. | 345/211 |
| 2013/0135272 | A1 * | 5/2013 | Park | G09G 3/3233 345/211 |

FOREIGN PATENT DOCUMENTS

| | | |
|---|---|---|
| KR | 10-2010-0123269 | 11/2010 |
| KR | 10-2012-0009632 | 2/2012 |
| KR | 10-1244644 | 3/2013 |
| KR | 10-2013-0058496 | 6/2013 |

* cited by examiner

*Primary Examiner* — Thuy Pardo

(74) *Attorney, Agent, or Firm* — Lewis Roca Rothgerber Christie LLP

(57) ABSTRACT

A display device Includes a control board including a timing controller (TCON) for controlling driving of the display device, and further including a driving memory for storing driving data for driving the display device, and a source board coupled to the control board by a connection cable, the source board including a driving integrated circuit (IC) for outputting a data signal, and further including a panel memory for storing panel characteristic data for compensating for the data signal.

18 Claims, 5 Drawing Sheets

DISPLAY DEVICE AND DRIVING METHOD THEREOF

CROSS-REFERENCE TO RELATED APPLICATION

This application claims priority to and the benefit of Korean Patent Application No. 10-2013-0119973 filed in the Korean Intellectual Property Office on Oct. 8, 2013, the entire contents of which are incorporated herein by reference.

BACKGROUND

1. Field

Embodiments of the present invention relate to a display device and a driving method thereof.

2. Description of the Related Art

A display device includes a plurality of scanning lines and a plurality of data lines that are coupled to a plurality of pixels. The pixels are located at crossing regions of the scanning lines and the data lines. Scanning signals having a gate-on voltage are sequentially applied to the scanning lines, and data signals corresponding to the scanning signals are applied to the data lines, thereby writing image data in the plurality of pixels.

Variations in image quality characteristics occur among display devices due to errors during the process of manufacturing the display device. For different display devices to display the same image quality characteristics, it may be beneficial to compensate variations in image quality characteristics of the display devices. Accordingly, during the process of manufacturing a display device, panel characteristic data may be generated to measure the image quality characteristics of the display device, and to compensate variations in image quality.

Meanwhile, driving data to generate various control signals, data signals, or the like at a driving timing generated according to a driving algorithm of the display device, structural features of the pixel, and the like are produced.

The panel characteristic data and the driving data are included in a single driving file, and a timing controller (hereinafter, referred to as TCON) controls driving of the display device by referencing the driving file.

When there is a need to update the driving data during the process of manufacturing a display device, the driving data and the panel characteristic data need to be updated together. The panel characteristic data and the driving data are produced by different processes while manufacturing a display device, which causes the inconvenience to repeat a process of measuring the image quality characteristics of the display device to produce the panel characteristic data so as to update the driving data.

When the driving file is updated to optimize or improve the driving algorithm or the driving timing for a finished display device, the panel characteristic data may disappear.

The above information disclosed in this Background section is only for enhancement of understanding of the background of the invention and therefore it may contain information that does not form the prior art that is already known in this country to a person of ordinary skill in the art.

SUMMARY

Embodiments of the present invention provide a display device capable of separately using driving data and panel characteristic data of the display device, and a driving method thereof.

An exemplary embodiment of the present invention provides a display device including a control board including a timing controller (TCON) for controlling driving of the display device, and further including a driving memory for storing driving data for driving the display device, and a source board coupled to the control board by a connection cable, the source board including a driving integrated circuit (IC) for outputting a data signal, and further including a panel memory for storing panel characteristic data for compensating for the data signal.

The source board may further include a gamma IC configured to generate a reference voltage for generating the data signal, and configured to provide the reference voltage to the driving IC.

The TCON may be coupled to the driving memory through wiring on the control board, and may be configured to acquire the driving data by communicating with the driving memory.

The TCON may be coupled to the gamma IC and to the panel memory via wirings on the control board, in the connection cable, and on the source board.

The TCON may be configured to acquire the panel characteristic data by communicating with the panel memory.

The TCON may be configured to communicate with the gamma IC to provide gamma correction information included in the panel characteristic data.

The gamma IC may be configured to generate the reference voltage based on the gamma correction information.

The TCON may be configured to communicate with the gamma IC, the panel memory, or the driving memory using I2C serial communication.

Another exemplary embodiment of the present invention provides a display device including a control board including a timing controller (TCON) configured to control driving of the display device, a driving memory configured to store driving data for driving the display device, and a gamma IC configured to generate a reference voltage for generating a data signal, and a source board coupled to the control board by a connection cable, the source board including a driving IC configured to output the data signal, and a panel memory configured to store panel characteristic data for compensating the data signal.

The TCON may be coupled to the driving memory and to the gamma IC through wiring on the control board, may be configured to acquire the driving data by data communication with the driving memory, and may be configured to provide gamma correction information included in the panel characteristic data to the gamma IC by data communication with the gamma IC.

The gamma IC may be configured to generate the reference voltage based on the gamma correction information.

The TCON may be coupled to the panel memory through wirings on the control board, in the connection cable, and on the source board, and may be configured to acquire the panel characteristic data by data communication with the panel memory.

The TCON may be configured to communicate using I2C serial communication.

Yet another exemplary embodiment of the present invention provides a method of driving a display device according to control of a timing controller (TCON), the method including receiving driving data from a driving memory, the driving data for controlling the driving of the display device, receiving panel characteristic data from a panel memory, the panel characteristic data for compensating a data signal of the display device, generating a reference voltage for generating the data signal based on gamma correction information included in the panel characteristic data, and generating a control signal for driving the display device based on the driving data.

The receiving of the driving data may include data communication with the driving memory mounted on a control board including the TCON.

The receiving of the panel characteristic data may include data communication with the panel memory mounted on a source board including a driving IC for outputting the data signal.

The generating of the reference voltage may include providing the gamma correction information to a gamma IC by data communication with the gamma IC mounted on the source board, and generating the reference voltage using the gamma IC.

The generating of the reference voltage may include providing the gamma correction information to a gamma IC mounted on the control board by data communication with the gamma IC, and generating the reference voltage using the gamma IC.

The driving data of the display device is stored in the driving memory provided on the control board, and the panel characteristic data is stored in the panel memory provided on the source board, such that there is no need to repeat the process of measuring the image quality characteristics of the display device to produce the panel characteristic data so as to update the driving data, and when the driving file is updated to improve the driving algorithm or the driving timing for the finished product of the display device, it is possible to prevent the panel characteristic data from being lost.

Further, when the driving data is corrupted, it is possible to restore the driving data without affecting the panel characteristic data by re-inputting the driving data by confirming only the version of the driving data.

Therefore, embodiments of the present invention reduce operation time required to perform updating while manufacturing a display device, and allow the finished product to be relatively easily updated or restored.

DETAILED DESCRIPTION

Figure 1:
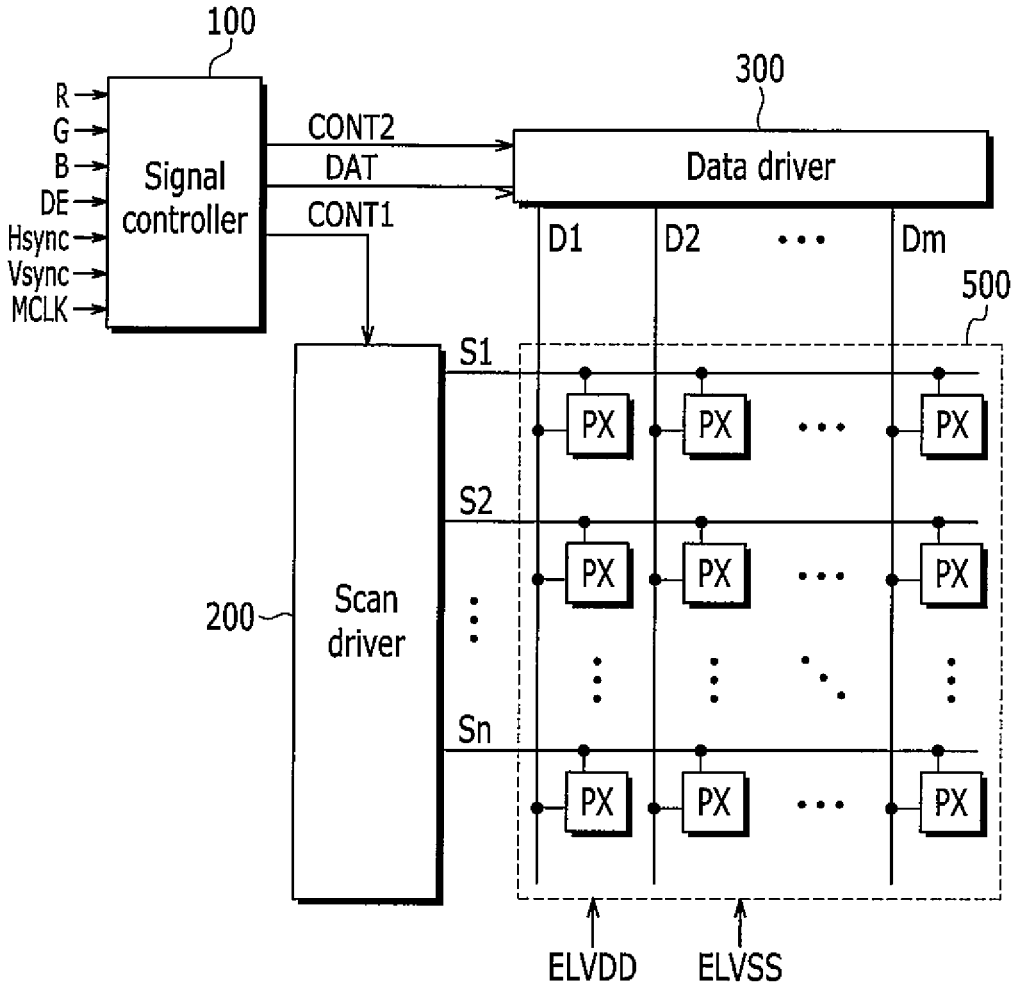
FIG. 1 is a block diagram illustrating a display device according to an exemplary embodiment of the present invention.

In the following detailed description, only certain exemplary embodiments of the present invention have been shown and described, simply by way of illustration. As those skilled in the art would realize, the described embodiments may be modified in various ways without departing from the spirit or scope of the present invention.

Further, in exemplary embodiments, because like reference numerals designate like elements having the same configuration, a first exemplary embodiment is representatively described, with only differing configurations are described in other exemplary embodiments thereafter.

To clearly describe the present invention, portions that are not associated with the description will be omitted. Like reference numerals designate like elements throughout the specification.

Throughout this specification and the claims that follow, when it is described that an element is "coupled" or "connected" to another element, the element may be "directly coupled" to the other element, or may be "electrically coupled" to the other element through one or more other elements. In addition, unless explicitly described to the contrary, the word "comprise" and variations thereof, such as "comprises" or "comprising", will be understood to imply the inclusion of stated elements, but not the exclusion of any other elements.

FIG. 1 is a block diagram illustrating a display device according to an exemplary embodiment of the present invention. Referring to FIG. 1, the display device includes a signal controller 100, a scan driver 200, a data driver 300, and a display unit 500.

The display unit 500 includes a plurality of pixels PXs arranged approximately in a matrix form, a plurality of scanning lines S1 to Sn, and a plurality of data lines D1 to Dm. The pixels PXs are respectively coupled to the scanning lines S1 to Sn and the data lines D1 to Dm. The scanning lines S1 to Sn extend approximately in a row direction to be approximately parallel with each other, and the data lines D1 to Dm extend approximately in a column direction to be approximately parallel with each other.

The signal controller 100 receives image signals R, G, and B, and also receives a synchronization signal, the signals being input from external devices. The image signals R, G, and B include information corresponding to luminance of the plurality of pixels. The luminance has a defined number, for example, gray values of $1024=2^{10}$, $256=2^{8}$, or $64=2^{6}$ (e.g., gray values corresponding to a gray scale). The synchronization signal includes a data enable signal DE, a horizontal synchronization signal Hsync, a vertical synchronization signal Vsync, and a main clock signal MCLK.

The signal controller 100 generates a first driving control signal CONT1, a second driving control signal CONT2, and image data DAT depending on the image signals R, G, and B, the data enable signal DE, the horizontal synchronization signal Hsync, the vertical synchronization signal Vsync, and the main clock signal MCLK. The signal controller 100 divides the image signals R, G, and B in a frame unit depending on the vertical synchronization signal Vsync, and divides the image signals R, G, and B in a scanning line unit depending on the horizontal synchronization signal Hsync, thereby generating the image data DAT. The signal controller 100 transfers the first driving control signal CONT1 to the scan driver 200. The signal controller 100 also transfers the image data DAT to the data driver 300 along with the second driving control signal CONT2.

The scan driver 200 is coupled to the plurality of scanning lines S1 to Sn, and generates the plurality of scanning signals according to the first driving control signal CONT1. The scan driver 200 may sequentially apply scanning signals having a gate-on voltage to respective ones of the scanning lines S1 to Sn.

The data driver 300 is coupled to the plurality of data lines D1 to Dm, samples and holds the input image data DAT according to the second driving control signal CONT2, and transfers a plurality of data signals to the plurality of data lines D1 to Dm. The data driver 300 applies the data signals having a voltage range (e.g., a predetermined voltage range) to the plurality of data lines D1 to Dm according to the scanning signals having the gate-on voltage.

Each of the above-mentioned driving devices (e.g., signal controller 100, scan driver 200, and data driver 300) may be directly mounted on the display unit 500 in at least one IC chip type, may be mounted on a flexible printed circuit film (FPC), may be attached to the display unit 500 in a tape carrier package (TCP) form, or may be mounted on a separate printed circuit board (PCB). Alternately, the driving devices 100, 200, and 300 may be integrated in the display unit 500 along with the plurality of scanning lines S1 to Sn and the plurality of data lines D1 to Dm.

Hereinafter, a pixel included in the organic light emitting display will be described under the assumption that the display device is an organic light emitting display (OLED). However, the exemplary embodiment of the present invention is not limited thereto, and the display device of other embodiments of the present invention may instead be a liquid crystal display (LCD), a plasma display panel (PDP), a field effect display (FED), an electrophoretic display device, and the like.

Figure 2:
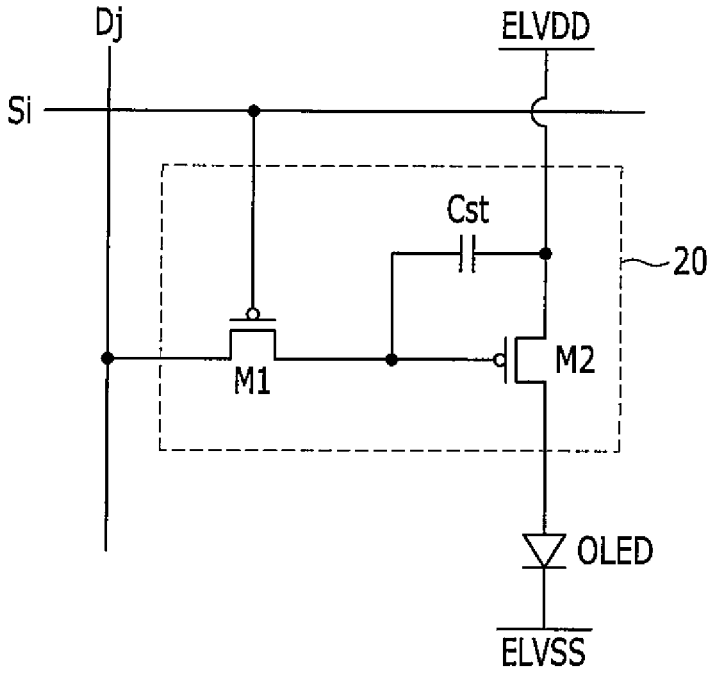
FIG. 2 is a circuit diagram illustrating an example of a pixel.

FIG. 2 is a circuit diagram illustrating an example of a pixel. Referring to FIG. 2, the pixel of the organic light emitting display includes an organic light emitting diode (OLED), and a pixel circuit 20 for controlling the organic light emitting diode (OLED). The pixel circuit 20 includes a switching transistor M1, a driving transistor M2, and a sustain capacitor Cst (e.g., a storage capacitor).

A configuration of the pixel circuit 20 that includes two transistors M1 and M2 and one capacitor Cst is described herein by way of example, but the pixel circuit of the organic light emitting display may be variously configured and operated. Therefore, the display device according to the exemplary embodiment of the present invention is not limited to the presented configuration of the pixel circuit.

The switching transistor M1 includes a gate electrode coupled to a scanning line Si, one electrode coupled to a data line Dj, and another electrode coupled to a gate electrode of the driving transistor M2 (with respect to scanning line Si and data line Dj, $1 \leq i \leq n$, and $1 \leq j \leq m$).

The driving transistor M2 includes a gate electrode coupled to the other electrode of the switching transistor M1, one electrode coupled to a first power supply voltage ELVDD, and another electrode coupled to an anode of the organic light emitting diode (OLED).

The sustain capacitor Cst includes one electrode coupled to the first power supply voltage ELVDD, and another electrode coupled to the gate electrode of the driving transistor M2. The sustain capacitor Cst is charged with the data voltage that is applied to the gate electrode of the driving transistor M2, and stores the charged data voltage even after the switching transistor M1 is turned off.

The organic light emitting diode (OLED) includes an anode coupled to the other electrode of the driving transistor M2, and a cathode coupled to a second power supply voltage ELVSS. The organic light emitting diode (OLED) may emit light of one of primary colors. An example of the primary colors may include three primary colors of red, green, and blue, and a desired color may be displayed by a spatial or temporal combination of the three primary colors.

An organic emission layer of the organic light emitting diode (OLED) may be made of low molecular weight organic materials or high molecular weight organic materials, such as poly 3,4-ethylenedioxythiophene (PEDOT). Further, the organic emission layer may be a multilayer including at least one of a light emitting layer, a hole injection layer (HIL), a hole transporting layer (HTL), an electron transporting layer (ETL), and an electron injection layer (EIL). When the organic emission layer includes all of the abovementioned layers, the hole injection layer is located on a pixel electrode that is an anode, and the hole transporting layer, the light emitting layer, the electron transporting layer, and the electron injection layer are sequentially stacked thereon.

The organic emission layer may include a red organic emission layer that emits red light, a green organic emission layer that emits green light, and a blue organic emission layer that emits blue light, in which the red organic emission layer, the green organic emission layer, and the blue organic emission layer are each respectively formed in a red sub-pixel, a green sub-pixel, and a blue sub-pixel to implement color images.

Further, the organic emission layer may implement the color images by stacking the red organic emission layer, the green organic emission layer, and the blue organic emission layer in all of the red sub-pixel, the green sub-pixel, and the blue sub-pixel, and by forming a red filter, a green filter, and a blue filter for each of the sub-pixels. As another example, the organic emission layer may implement the color images by forming a white organic emission layer that emits white light in all of the red sub-pixel, the green sub-pixel, and the blue sub-pixel, and by forming the red filter, the green filter, and the blue filter for each of the sub-pixels. In the case of implementing the color images using the white organic emission layer and the color filters, there is no need to use a deposition mask for depositing the red organic emission layer, the green organic emission layer, and the blue organic emission layer on each of the sub-pixels (i.e., the red sub-pixel, the green sub-pixel, and the blue sub-pixel).

The white organic emission layer described may be formed of a single organic emission layer, and may be configured to emit white light by stacking the plurality of organic emission layers. For example, the white organic emission layer may also include a configuration to be able to emit the white light by combining at least one yellow organic emission layer with at least one blue organic emission layer, a configuration able to emit the white light by combining at least one cyan organic emission layer with at least one red organic emission layer, a configuration able to emit the white light by combining at least one magenta organic emission layer with at least one green organic emission layer, and the like.

The switching transistor M1 and the driving transistor M2 may each be a p-channel field effect transistor. In this case, the gate-on voltage to turn on the switching transistor M1 and the driving transistor M2 is a low level voltage, and a gate-off voltage to turn off the switching transistor M1 and the driving transistor M2 is a high level voltage.

The p-channel field effect transistor is shown herein, but either or both of the switching transistor M1 and the driving transistor M2 may be an n-channel field effect transistor. The gate-on voltage to turn on the n-channel field effect transistor is a high level voltage, and the gate-off voltage to turn off the n-channel field effect transistor is a low level voltage.

Either or both of the switching transistor M1 and the driving transistor M2 may be an oxide thin film transistor (oxide TFT) in which a semiconductor layer is made of oxide semiconductor.

The oxide semiconductor may include any one of oxide that is based on titanium (Ti), hafnium (Hf), zirconium (Zr), aluminum(Al), tantalum (Ta), germanium (Ge), zinc (Zn), gallium (Ga), tin (Sn), or indium (In), and any one of zinc oxide (ZnO), indium-gallium-zinc oxide (InGaZnO4), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O), all of which are composite oxides thereof.

The semiconductor layer includes a channel region that is not doped with impurities, and a source region and a drain region that are formed by doping both sides of the channel region with impurities. Herein, the impurities vary depending on the kind of thin film transistor, and may be an N-type impurity or a P-type impurity.

When the semiconductor layer is made of the oxide semiconductor, a separate protective layer may be added to protect the oxide semiconductor, which is vulnerable to external environments such as high temperature.

An operation of the pixel will be briefly described.

The scan driver 200 sequentially applies the scanning signals having the gate-on voltage to the scanning lines S1 to Sn, and when the scanning signal having the gate-on voltage is applied to the scanning line Si, the switching transistor M1 is turned on. In this case, the data driver 300 applies the data signals to the plurality of data lines D1 to Dm, and the data signal applied to the data line Dj is applied to the other electrode of the sustain capacitor Cst to charge the sustain capacitor Cst. The driving transistor M2 controls a current amount flowing from the first power supply voltage ELVDD to the organic light emitting diode (OLED) according to the voltage charged in the sustain capacitor Cst. The current flowing from the first power supply voltage ELVDD through the driving transistor M2 flows through the organic light emitting diode (OLED), and the organic light emitting diode (OLED) generates light corresponding to the current amount flowing through the driving transistor M2.

Hereinafter, a panel module including the signal controller 100 and the data driver 300 will be described.

Figure 3:
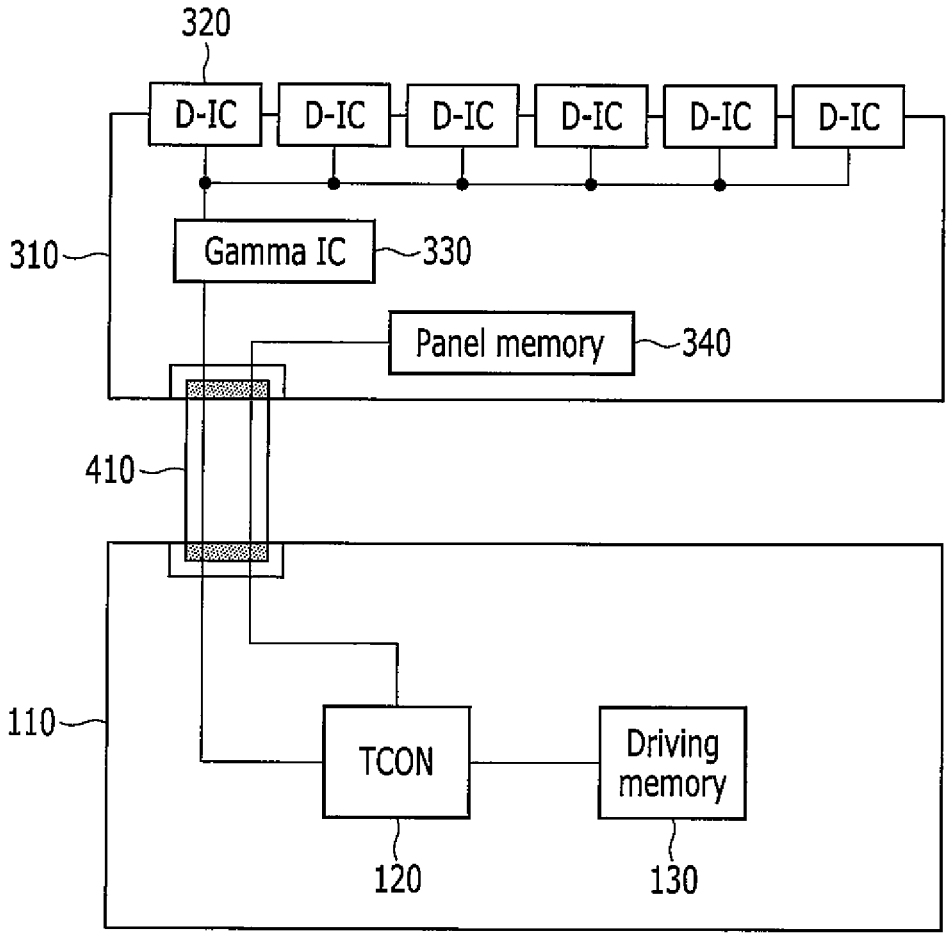
FIG. 3 is a configuration diagram illustrating a panel module according to an exemplary embodiment of the present invention.
Figure 4:
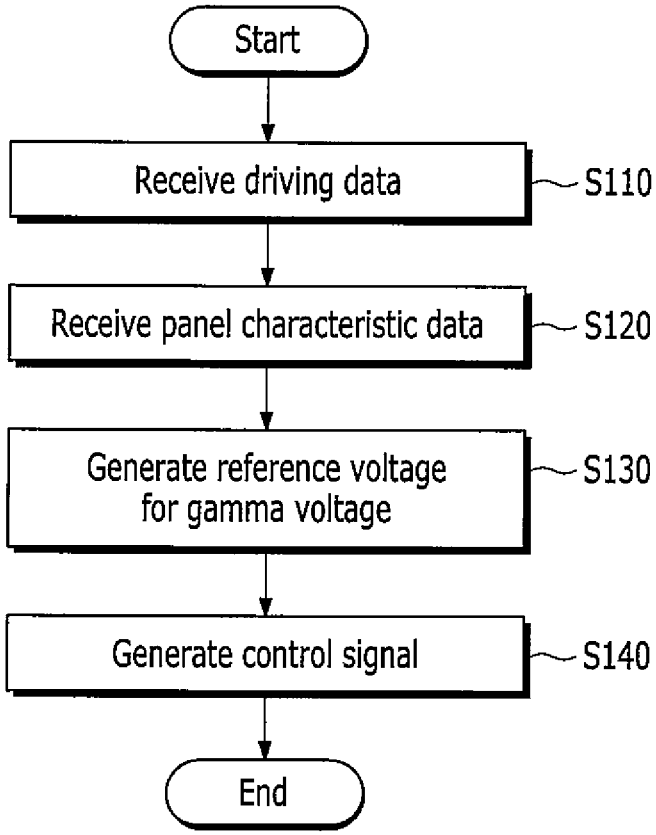
FIG. 4 is a flow chart of a driving method of a display device according to an exemplary embodiment of the present invention.

FIG. 3 is a configuration diagram illustrating a panel module according to an exemplary embodiment of the present invention. FIG. 4 is a flow chart of a driving method of a display device according to the exemplary embodiment of the present invention shown in FIG. 3. Referring to FIGS. 3 and 4, the panel module includes a control board 110 and a source board 310.

The control board 110 is provided with a timing controller (TCON) 120 and a driving memory 130. The control board 110 may be a printed circuit board (PCB).

The TCON 120 serves as the signal controller 100 described with reference to FIG. 1. That is, the TCON 120 controls the driving of the display device.

The driving memory 130 stores the driving data for driving the display device. The driving data may include control data for driving the display device at a driving timing chosen according to the driving algorithm of the display device, the pixel circuit 20, and the like. For example, the driving data may include driving timings for the first driving control signal CONT1 applied to the scan driver 200, and for the second driving control signal CONT2 applied to the data driver 300. The driving memory 130 may be provided as an electrically erasable programmable read-only memory (EEPROM), which is a nonvolatile memory.

The control board 110 on which the TCON 120 and the driving memory 130 are mounted may be collectively referred to as a control printed board assembly (PBA).

The source board 310 is provided with a plurality of driving integrated circuits (ICs) 320, a gamma IC 330, and a panel memory 340. The source board 310 may be a PCB.

The plurality of driving ICs (e.g., D-ICs) 320 serves as the data driver 300 described with reference to FIG. 1. That is, the driving ICs 320 output the data signals to the plurality of data lines D1 to Dm.

The gamma IC 330 generates a reference voltage for generating a gamma voltage.

The panel memory 340 stores the panel characteristic data. The panel characteristic data compensates for the data signals, and may include data for measuring the image quality characteristics of the display device, and for compensating the image quality characteristics in manufacturing a display device. For example, the panel characteristic data may include gamma correction information for correcting gamma characteristics according to the manufacturing process of a display device, a gamma correction look-up table (LUT), image quality correction algorithm information for correcting image quality, a unique number of the panel, history information of the panel, reference values of the driving algorithm corresponding to the configuration of the panel, and the like. The panel memory 340 may be provided as the EEPROM, which is nonvolatile memory.

The source board 310, including the plurality of driving ICs 320, the gamma IC 330, and the panel memory 340 mounted thereon, may be collectively referred to as a source PBA.

A connection cable 410 couples the control board 110 to the source board 310. The connection cable 410 may be provided as a flexible flat cable (FFC).

The TCON 120 is coupled to the driving memory 130 through a wiring formed on the control bard 110. Further, the TCON 120 is coupled to the gamma IC 330 and to the panel memory 340, respectively, through the wirings formed on the control board 110, the connection cable 410, and the source board 310. The TCON 120 may acquire the driving data from the driving memory 130 by data communication with the driving memory 130. The TCON 120 may acquire the panel characteristic data from the panel memory 340 by the data communication with the panel memory 340. The TCON 120 may provide the gamma correction information or the gamma correction LUT information to the gamma IC 330 by the data communication with the gamma IC 330. The data communication between the TCON 120 and the driving memory 130, the data communication between the TCON 120 and the panel memory 340, and the data communication between the TCON 120 and the gamma IC 330 may be performed by I2C (inter integrated circuit) serial communication type.

Hereinafter, the operation of the panel module will be described with reference to FIG. 4.

When power is applied to the display device, and when the driving of the display device starts, the TCON 120 receives the driving data from the driving memory 130 (S110). The TCON 120 may acquire information on the driving algorithm of the display device, the chosen driving timing of the display device, and the like based on the driving data.

The TCON 120 receives the panel characteristic data from the panel memory 340 (S120). The TCON 120 may acquire the gamma correction information, the gamma correction LUT, the image quality correction algorithm information, the unique number of the panel, the history information of the panel, information on the reference values of the driving algorithm corresponding to the configuration of the panel, and the like, based on the panel characteristic data.

The TCON 120 provides the gamma correction information or the gamma correction LUT information to the gamma IC 330, and the gamma IC 330 generates a reference voltage for the gamma voltage based on the gamma correction information or based on the gamma correction LUT information (S130). The plurality of driving ICs 320 may output the gamma voltage for each gray (e.g., each gray value, or gray level), which is set to make the luminance depending on the grays be a 2.2 gamma curve, as the data signal. In this case, the gamma voltage for each gray is generated by dividing between the reference voltage and the ground voltage. The gamma IC 330 generates the reference voltage depending on the gamma correction information or depending on the gamma correction LUT information, and provides the generated reference voltage to the plurality of driving ICs 320. Accordingly, the plurality of driving ICs 320 may output the data signal with the corrected gamma characteristics depending on the manufacturing process of the display device.

The TCON 120 may generate various control signals for driving the display device based on the driving data (S140). That is, the TCON 120 may generate the first driving control signal CONT1 and the second driving control signal CONT2 depending on the information on the driving algorithm of the display device, the driving timing of the display device, and the like.

As described above, the driving data is stored in the driving memory 130 on the control board 110, and the panel characteristic data is stored in the panel memory 340 on the source board 310, such that it is possible to reduce the operation time required to perform the updating, etc. in the process of manufacturing a display device, and such that it is possible to easily update or restore the finished product.

For example, when the driving timing of the display device, the driving algorithm of the display device, etc. are updated in the process of developing or mass producing the display device, the overall panel module needs to be changed in the related art, but because there is no need to change the source board 310 in the proposed configuration of the panel module, only the control board 110 is changed. Therefore, the operation time required to change the source board 310 may be reduced.

Further, in updating the driving timing, the driving algorithm, and the like of a finished product display device, the driving data and the panel characteristic data are separately stored, such that the panel characteristic data may be maintained, and only the driving data may be updated. Further, when the driving data is damaged or corrupted, it is possible to restore the driving data without affecting the panel characteristic data by re-inputting the driving data through confirmation of only the version of the driving data.

Figure 5:
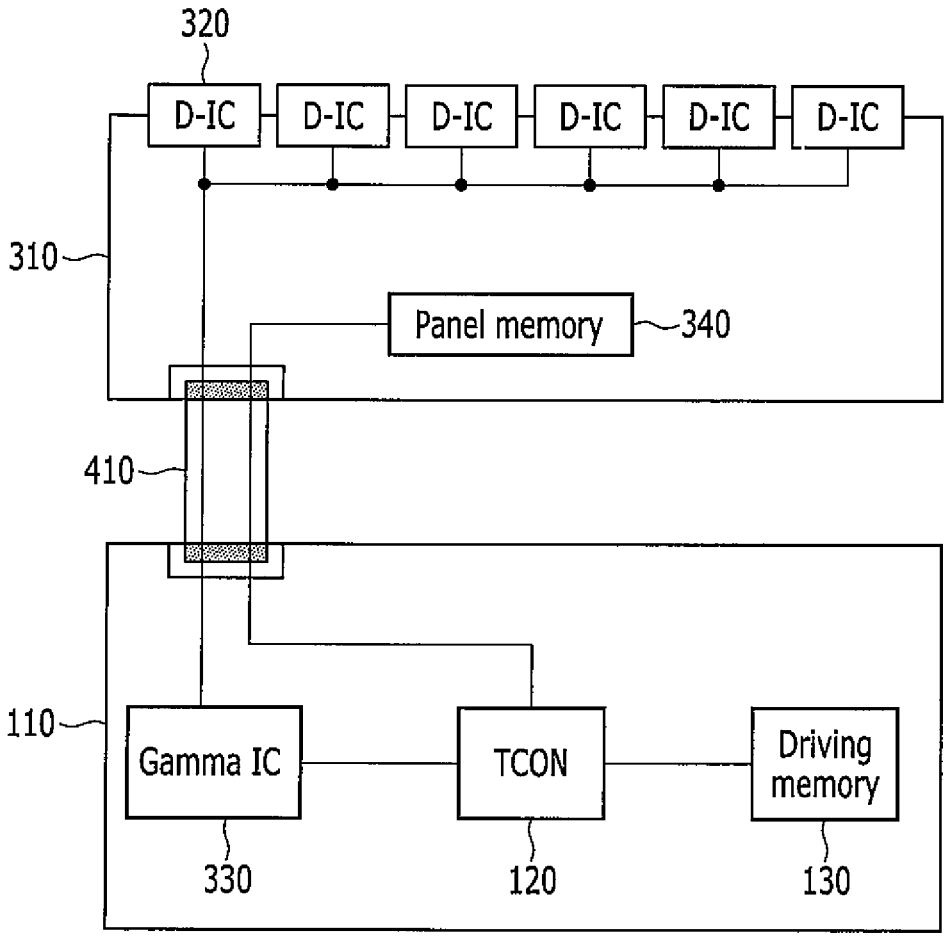
FIG. 5 is a configuration diagram illustrating a panel module according to another exemplary embodiment of the present invention.

FIG. 5 is a configuration diagram illustrating a panel module according to another exemplary embodiment of the present invention. The difference of the panel module of FIG. 5 from the panel module of FIG. 3 is that the gamma IC 330 is mounted on the control board 110 instead of the source board 310. The TCON 120 is coupled to the gamma IC 330 through the wiring on the control board 110, and may provide the gamma correction information or the gamma correction LUT information to the gamma IC 330 by the data communication with the gamma IC 330.

When the gamma IC 330 is mounted on the source board 310 (as illustrated in FIG. 3), the voltage variation between the plurality of driving ICs 320 may be reduced. When the gamma IC 330 is mounted on the control board 110 (as illustrated in FIG. 5), the source board 310 may be more simplified, and the voltage variation between the plurality of driving ICs 320 may be improved by the image quality correction value algorithm.

The components of the embodiment of FIG. 5, other than the position of the gamma IC 330, are the same as the ones described in FIG. 3, and therefore the detailed description thereof will be omitted.

The accompanying drawings and the detailed description of the present invention are illustrated by way of example and are not used to limit the meaning or limit the scope of the present invention described in claims but are used to describe the present invention. Therefore, it will be appreciated to those skilled in the art that various modifications are made and other equivalent embodiments are available. Therefore, a true technical scope of the present invention will be defined by the technical spirit of the scope of the appending claims and their equivalents.

DESCRIPTION OF SYMBOLS

| | |
|---|---|
| 100: Signal controller | 110: Control board |
| 120: TCON | 130: Driving memory |
| 200: Scan driver | 300: Data driver |
| 310: Source board | 320: Driving IC |
| 330: Gamma IC | 340: Panel memory |
| 410: Connection cable | 500: Display unit |

What is claimed is:

1. A display device comprising:

a control board comprising a timing controller (TCON) for controlling driving of the display device, and further comprising a driving memory for storing driving data for driving the display device, the driving data including control data for driving the display device at a driving timing chosen according to a driving algorithm of the display device; and a source board coupled to the control board by a connection cable, the source board comprising a driving integrated circuit (IC) for outputting a data signal, and further comprising a panel memory for storing panel characteristic data for compensating for the data signal.

2. The display device of claim 1, wherein the source board further comprises a gamma IC configured to generate a reference voltage for generating the data signal, and configured to provide the reference voltage to the driving IC.

3. The display device of claim 2, wherein the TCON is coupled to the driving memory through wiring on the control board, and is configured to acquire the driving data by communicating with the driving memory.

4. The display device of claim 3, wherein the TCON is coupled to the gamma IC and to the panel memory via wirings on the control board, in the connection cable, and on the source board.

5. The display device of claim 4, wherein the TCON is configured to acquire the panel characteristic data by communicating with the panel memory.

6. The display device of claim 5, wherein the TCON is configured to communicate with the gamma IC to provide gamma correction information included in the panel characteristic data.

7. The display device of claim 6, wherein the gamma IC is configured to generate the reference voltage based on the gamma correction information.

8. The display device of claim 7, wherein the TCON is configured to communicate with the gamma IC, the panel memory, or the driving memory using I2C serial communication.

9. A display device comprising:

a control board comprising a timing controller (TCON) configured to control driving of the display device, a driving memory configured to store driving data for driving the display device, and a gamma IC configured to generate a reference voltage for generating a data signal, the driving data including control data for driving the display device at a driving timing chosen according to a driving algorithm of the display device; and a source board coupled to the control board by a connection cable, the source board comprising a driving IC configured to output the data signal, and a panel memory configured to store panel characteristic data for compensating the data signal.

10. The display device of claim 9, wherein the TCON is coupled to the driving memory and to the gamma IC through wiring on the control board, is configured to acquire the driving data by data communication with the driving memory, and is configured to provide gamma correction information included in the panel characteristic data to the gamma IC by data communication with the gamma IC.

11. The display device of claim 10, wherein the gamma IC is configured to generate the reference voltage based on the gamma correction information.

12. The display device of claim 10, wherein the TCON is coupled to the panel memory through wirings on the control board, in the connection cable, and on the source board, and is configured to acquire the panel characteristic data by data communication with the panel memory.

13. The display device of claim 12, wherein the TCON is configured to communicate using I2C serial communication.

14. A method of driving a display device according to control of a timing controller (TCON), the method comprising:

receiving driving data from a driving memory, the driving data for controlling the driving of the display device, the driving data including control data for driving the display device at a driving timing chosen according to a driving algorithm of the display device;

receiving panel characteristic data from a panel memory, the panel characteristic data for compensating a data signal of the display device;

generating a reference voltage for generating the data signal based on gamma correction information included in the panel characteristic data; and generating a control signal for driving the display device based on the driving data.

15. The method of claim 14, wherein the receiving of the driving data comprises data communication with the driving memory mounted on a control board comprising the TCON.

16. The method of claim 15, wherein the receiving of the panel characteristic data comprises data communication with the panel memory mounted on a source board comprising a driving IC for outputting the data signal.

17. The method of claim 16, wherein the generating of the reference voltage comprises:

providing the gamma correction information to a gamma IC by data communication with the gamma IC mounted on the source board; and generating the reference voltage using the gamma IC.

18. The method of claim 16, wherein the generating of the reference voltage comprises:

providing the gamma correction information to a gamma IC mounted on the control board by data communication with the gamma IC; and generating the reference voltage using the gamma IC.

* * * * *